United States Patent [19]

Piesinger

[11] 4,161,733

[45] Jul. 17, 1979

[54] NULL STEERING APPARATUS INCLUDING WEIGHT OSCILLATION ELIMINATING MEANS

[75] Inventor: Gregory H. Piesinger, Scottsdale, Ariz.

[73] Assignee: Motorola, Inc., Schaumburg, Ill.

[21] Appl. No.: 834,592

[22] Filed: Sep. 19, 1977

[51] Int. Cl.[2] ..... H01Q 3/26

[52] U.S. Cl. ..... 343/100 SA; 343/100 LE; 343/854

[58] Field of Search ..... 343/100 SA, 100 LE, 343/854

[56] References Cited

U.S. PATENT DOCUMENTS

| | | | |
|---|---|---|---|
| 4,032,922 | 6/1977 | Provencher | 343/100 SA X |
| 4,079,381 | 3/1978 | Piesinger | 343/100 SA |

*Primary Examiner*—Maynard R. Wilbur
*Assistant Examiner*—Richard E. Berger
*Attorney, Agent, or Firm*—Eugene A. Parsons

[57] ABSTRACT

In a multiple antenna array including null steering apparatus of the type utilizing a reference signal generator for preventing a null on a desired signal, weight oscillation eliminating apparatus for shifting the phase of the reference signal to make it generally equal and opposite to the desired signal so that weight oscillation of the system is eliminated.

8 Claims, 5 Drawing Figures

NULL STEERING APPARATUS INCLUDING WEIGHT OSCILLATION ELIMINATING MEANS

BACKGROUND OF THE INVENTION

In null steering apparatus for use with multiple antenna arrays, such as described in the following copending U.S. patent applications:

Ser. No. 744,008, now U.S. Pat. No. 4,079,379, filed Nov. 22, 1976, entitled "Null Steering Apparatus for a Multiple Antenna Array"; Ser. No. 744,009, now U.S. Pat. No. 4,079,380, filed Nov. 22, 1976, entitled "Null Steering Apparatus for a Multiple Antenna Array on an FM Receiver"; and Ser. No. 744,010, now U.S. Pat. No. 4,079,381, filed Nov. 22, 1976, entitled "Null Steering Apparatus for a Multiple Antenna Array on an AM Receiver", all assigned to the same assignee as the present application, a feedback circuit is utilized to null out signals introduced into the circuit by the antenna array and a reference signal is generated to subtract a desired signal from the feedback circuit to prevent the desired signal from being nulled out. The reference signal generated must be the same phase as the desired signal or there is a tendency for the feedback circuit to oscillate as the circuit attempts to adapt. This oscillation of the output signal is undesirable because it will cause the carrier frequency at the output to be at a different frequency than the received carrier frequency. Also, the oscillation tends to degrade the null depth when an undesirable signal is present.

SUMMARY OF THE INVENTION

The present invention pertains to a multiple antenna array including null steering apparatus of the type utilizing reference signal generating means for preventing a null on a desired signal wherein weight oscillation eliminating means are incorporated in the reference signal generating means to adjust the phase of the reference signal to coincide with the phase of the desired signal as applied to the reference signal generating means.

More specifically, the phase of the desired signal and the reference signal are compared and an error signal, representative of the difference therebetween, is utilized to adjust phase shifting means in the reference signal generating means so that the phase of the reference signal and the desired signal are substantially identical. With the phases of the two signals substantially identical, the oscillation in the output signal of the circuitry is eliminated.

It is an object of the present invention to provide new and improved weight oscillation eliminating means for use in null steering apparatus associated with multiple antenna arrays.

It is a further object of the present invention to provide a multiple antenna array including null steering apparatus of the type utilizing reference signal generating means wherein coherence between the output frequency and the input frequency is improved and deeper nulls are formed.

These and other objects of this invention will become apparent to those skilled in the art upon consideration of the accompanying specification, claims and drawings.

BRIEF DESCRIPTION OF THE DRAWINGS

Referring to the drawings, wherein like characters indicate like parts throughout the figures.

DESCRIPTION OF THE PREFERRED EMBODIMENTS

Figure 1:
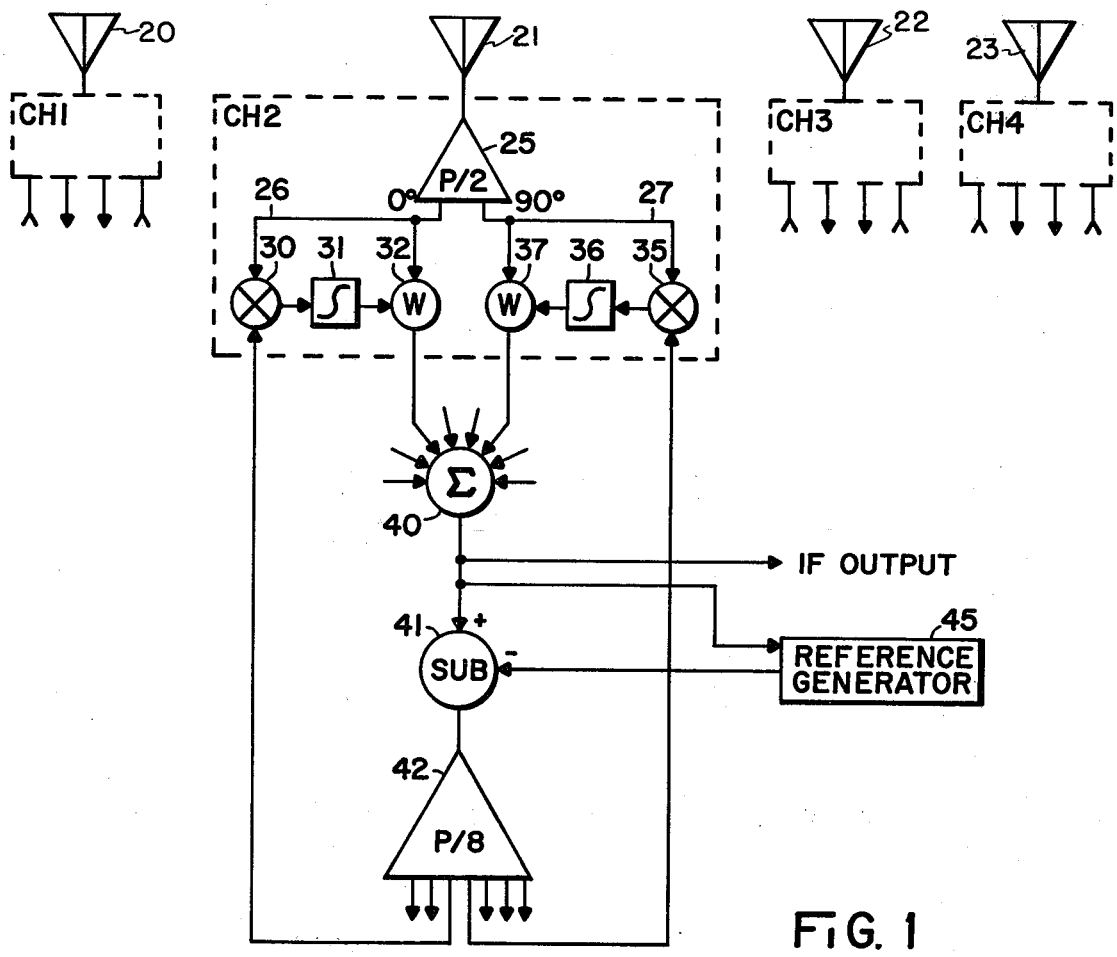
FIG. 1 is a block diagram of a multiple antenna array incorporating null steering apparatus of the type utilizing reference signal generating means.

Referring specifically to FIG. 1, a multiple antenna array is illustrated, consisting of four antennas designated 20–23. Any specific signal on any one of the antennas 20–23 can be represented by a phasor and each antenna has associated therewith electronics, designated channel one through channel four, for manipulating the signal so that the phasor has substantially any desired amplitude and phase. Each of the channels one through four are identical and, therefore, only channel two will be described in detail and it should be understood that each of the remaining channels operates in a similar fashion and each contains similar apparatus.

A ninety degree (quadrature) hybrid, or phase splitter, 25 is connected to receive the signals from antenna 21 and supply in-phase and quadrature components thereof on lines 26 and 27, respectively. It should be understood that circuitry can be interposed between the antenna and the phase splitters to alter the frequency of the incoming signal, e.g., IF type circuitry. The line 26, transmitting the in-phase component, is connected to one input of a correlator, which may be a mixer or multiplier 30, that provides a signal at an output thereof which is representative of the correlation between the signal applied from the line 26 and a signal applied to a second input of the correlator 30. Output signals from the correlator 30 are integrated in an integrator 31 and applied to a control input of a weighting circuit 32, a second input of which is connected to the line 26. The weighting circuit 32 may be, for example, a variable amplifier or attenuator wherein the signal from the integrator 31 adjusts the amplitude, or weight, of the signal passing through the weighting circuit 32 from the line 26. In a similar fashion, the line 27 is connected to one input of a correlator 35, which correlator 35 has an output connected through an integrator 36 to the control input of a weighting circuit 37. The weighting circuit 37 also has an input connected to the line 27. The correlater 35, integrator 36 and weighting circuit 37 are substantially identical to the the correlator 30, integrator 31 and weighting circuit 32, respectively.

The outputs of the weighting circuits 32 and 37, as well as similar outputs from channels 1, 3 and 4, are applied to a summing circuit 40. The summing circuit 40 has a single output which is connected to one input of a subtractor circuit 41 with a single output which is applied through a power splitter 42 to each of the second inputs of the correlators 30, 35, and the two correlators in each of the channels 1, 3 and 4. The output of the summing circuit 40 supplies an output signal to subsequent circuitry (not shown) on an output labeled "IF output". The output of the summing circuit 40 is also connected to an input of a reference signal generator 45, an output of which is connected to a second input of the subtractor circuit 41.

In the operation of the multiple antenna array null steering apparatus illustrated, a transmitter on an airplane or the like transmits a data signal, which may be for example an AM signal, or amplitude modulated carrier, and simultaneously transmits an identifier signal, which may be for example a low-level identifier signal substantially in phase quadrature with the AM signal modulated on the carrier (such as a secure PN code). For more details on this specific type of null steering apparatus refer to the above described co-pending application, Ser. No. 744,010.

Signals from the antenna 21 are split into an in-phase component and a quadrature component in the phase splitter 25. The two signal components are then weighted by the weighting circuits 32 and 37 and summed together, along with the signals from the other antenna weighters, in the summing circuit 40. The values of the weighting circuits 32 and 37 are automatically adjusted by feeding back the output of the summing circuit 40 through the subtractor 41 and power splitter 42 to the correlators 30 and 35. The feedback signal is correlated with the nonweighted signal from the phase shifter 25 to create a correlation voltage which is integrated and used to drive the weighting circuits 32 and 37. The weighting circuits 32 and 37 are always driven in such a manner as to minimize the feedback signal. When the feedback signal is completely eliminated, corresponding to forming a complete null, the output of the correlators 30 and 35 is zero and the system has fully adapted. A null steerer implemented in this manner will null out all signals as long as the number of signals is equal to or less than N-1, where N is the number of antennas.

A signal present at the antenna can be represented by a phasor and the phase splitter 25 and weighting circuits 32 and 37 are utilized to shift the phasor to any phase and amplitude desired. For example, if a jamming signal is present on antennas 20 and 21, the null steerer will shift the two signals (phasors) such that they are of equal amplitude and opposite phase. When these two weighted signals are then summed together in the summing circuit 40, they will cancel, thereby forming an antenna pattern null in the direction of the jamming signal. The process is similar when the jamming signal is present on all four antennas.

The reference signal applied to the subtracting circuit 41 by the reference generator 45 prevents nulling out the AM or desired signal. By subtracting the reference signal in the subtracting circuit 41, the AM signal is not fed back to the correlators 30 and 35 and, since the AM signal is not present at the correlators 30 and 35, no null will be formed thereon and a lobe will be formed in the antenna pattern in the direction of the AM signal. The important point to be understood is that the system has fully adapted only when the feedback signal is zero. Therefore, if the reference signal power output from the reference generator 45 equals the AM signal output power from the summing circuit 40 the output of the subtracting circuit 41, which is the feedback signal to the correlators 30 and 35, will be equal to zero and a lobe will be formed on the AM signal.

Figure 2:
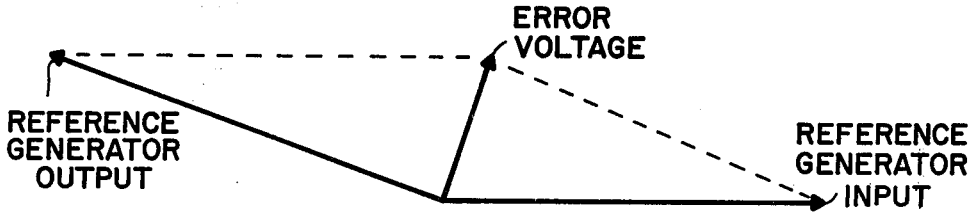
FIG. 2 is a vector diagram illustrating the generation of weight errors.
Figure 3:
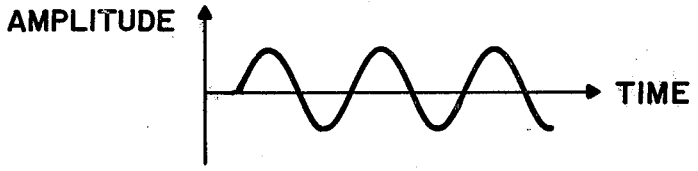
FIG. 3 is a graphic simulation of a weight error oscillation.

In general, as described in the above referenced co-pending application, Ser. No. 744,010, the reference generator 45 includes a narrow band filter and an AGC amplifier so that if the received AM carrier is at the center frequency $f_o$, the carrier phase at the output of the reference generator 45 is exactly 180° out of phase with respect to the carrier at the output of the summing circuit 40. The null steerer will adapt until the carrier amplitude at the output of the summing circuit 40 is exactly equal to the carrier amplitude at the output of the reference generator 45. At this point the null steerer has fully adapted and the carrier cancels in the subtractor 41 which prevents it from being fed back to the correlators 30 and 35. However, if the received AM carrier is at a frequency not equal to the center frequency $f_o$, the carrier phase at the output of the reference generator 45 is not exactly 180° out of phase with respect to the carrier at the output of the summing circuit 40. This results because the narrow band filter in the reference generator 40 has phase slope versus frequency. In this condition, the carrier will not completely cancel in the subtractor 41 even if the amplitude of the carrier at the two inputs to the subtractor 41 are equal. The resulting error voltage from the subtractor 41 is illustrated in FIG. 2. When the phase between the input and output of the reference generator 45 is not exactly 180°, the error voltage shown in FIG. 2 will cause the weighters 32 and 37 to shift slightly in an attempt to make the carrier signal at the output of the summing circuit 40 180° out of phase with the reference signal from the reference generator 45. The attempt is futile, however, because as the carrier phase into the reference generator 45 changes, the phase shift within the reference generator 45 doesn't change and the phase offset persists. The constant carrier phase offset out of the subtractor 41 causes the weighters 32 and 37 to continually adapt in an effort to cancel the carrier in the subtractor 41. This continual adaption process is called weight oscillation. The weighter drive voltage under this condition is shown in FIG. 3. The weighter drive voltage oscillates at a low frequency determined by the integrator loop bandwidth, the carrier phase offset, and the loop gain. This weight oscillation causes the carrier frequency out of the summing circuit 40 to be at a different frequency than the received carrier frequency. The oscillation also tends to degrade the null depth when an unwanted or jammer signal is present.

Figure 4:
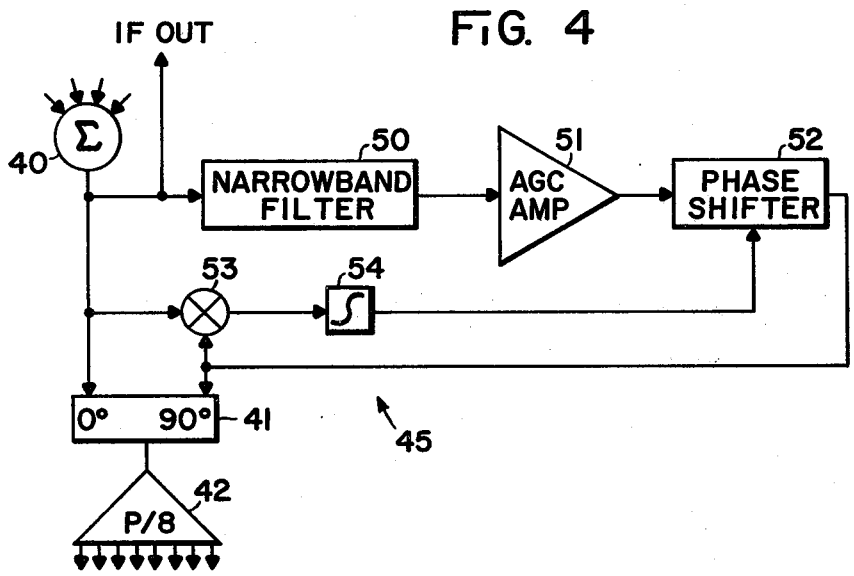
FIG. 4 is a block diagram embodying the present invention and illustrating in detail the reference signal generating apparatus illustrated generally in FIG. 1.

To eliminate the weighter oscillation problem, circuitry embodying the present invention, illustrated in FIG. 4, has been devised. In the embodiment of FIG. 4, the reference signal generator 45 includes a narrowband filter 50, an AGC amplifier 51 and a phase shifter 52. The signal from the summing circuit 40 is applied through the filter 50 to the amplifier 51 and the output thereof is applied to an input of the phase shifter 52. The output of the phase shifter 52 is applied to one input of the subtracting circuit 41. The other input of the subtracting circuit 41 is connected to the output of the summing circuit 40 and the output of the subtracting circuit 41 is connected to the power splitter 42. In the present embodiment, the subtracting circuit 41 is a quadrature hybrid circuit, which is readily available commercially, and the two inputs must be 90° out of phase to cancel at the output thereof. The output of the summing circuit 40 and the output of the phase shifter 52 are also applied to two inputs of a correlator 53, which may be a mixer or multiplier similar to the correlators 30 and 35 previously described. The correlator 53 has an output which is supplied through an integrator 54 to a control input of the phase shifter 52. In the present embodiment, a quadrature hybrid was chosen for the subtracting circuit 41 so that a 90° phase difference would be prevalent between the two signals, instead of 180°, because when the inputs to the correlator 53 are 90° out of phase, the correlator output is zero. Therefore, when the phase shifter 52 is properly adjusted, the input to the integrator 54 will be zero volts and the loop will cease to adapt. By using a quadrature hybrid for the subtracting circuit 41, the carrier will cancel at the output of the subtracting circuit 41 when the input phase difference is 90°.

As described in the above referenced co-pending application, the bandwidth of the filter 50 is just wide enough to pass the frequency uncertainty of the carrier. The filter 50 and amplifier 51 shift the phase of the signal passing therethrough approximately 90° but there will be some variation with frequency of the carrier because the narrowband filter 50 has a phase slope versus frequency. As the phase difference between the output signal of the summing circuit 40 and the output signal of the phase shifter 52 varies from 90°, the correlator 53 senses the error and supplies a signal through the integrator 54 to the phase shifter 52. The phase shifter 52 may be any circuit which adjusts the phase of the signal passing therethrough in accordance with a control signal applied to the control input thereof. This circuit may be a circuit very similar to the feedback loop associated with each antenna, 20 through 23, in the null steerer or it may be any of a variety of circuits commercially available such as the solid state voltage controlled phase shifter, Part Number 100D0590, sold by Daico, Industries.

Figure 5:
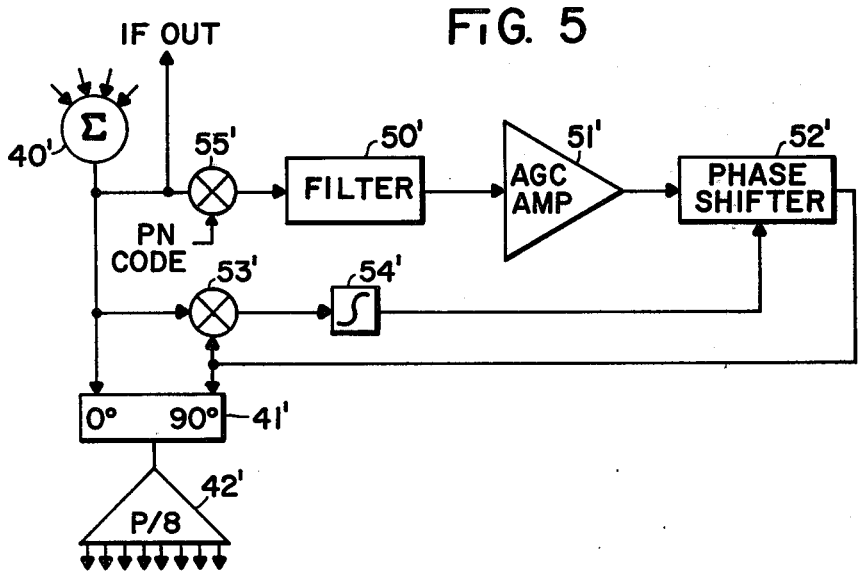
FIG. 5 is a block diagram similar to FIG. 4 of another embodiment of the present invention.

The embodiment illustrated in FIG. 4 is designed for the reception of AM signals wherein the carrier is utilized as the identifier signal. A second embodiment is illustrated in FIG. 5, the various components thereof being designated with a number having a prime thereon and similar components have similar numbers. In the embodiment of FIG. 5, a secure PN code is utilized to modulate the transmitted carrier to act as a low-level identifier signal. As described in the above reference co-pending application, Ser. No. 744,010, a decoder or mixer 55' receives the carrier modulated with the PN code from the output of the summing circuit 40'. An internally generated PN code is injected into a second input of the mixer 55', which internally generated PN code is exactly the same as the transmitted PN code so that only a CW (continuous wave) signal is available at the output thereof. The embodiment illustrated in FIG. 4 is referred to as a passive reference loop, whereas the embodiment illustrated in FIG. 5 is referred to as an active reference loop because an identifier is transmitted along with the desired signal. It should be understood that the present invention might be utilized with many other types of reference loops, both active and passive, and the two illustrated herein are simply for exemplary purposes.

Therefore, weight oscillation eliminating means are disclosed for use with null steering apparatus associated with a multiple antenna array. The weight oscillation eliminating means adjusts the phase between a desired signal and a generated reference signal to eliminate weight oscillation in the feedback circuit. By eliminating the weight oscillation, coherency between the received signals of the system and output signals thereof is greatly improved. Also, the null depth as applied to undesired signals, such as jamming signals and the like, is also greatly improved.

While I have shown and described specific embodiments of this invention, further modifications and improvements will occur to those skilled in the art. I desire it to be understood, therefore, that this invention is not limited to the particular forms shown and I intend in the appended claims to cover all modifications which do not depart from the spirit and scope of this invention.

What is claimed is:

1. In a multiple antenna array including null steering apparatus of the type utilizing reference signal generating means for preventing a null on a desired signal, weight oscillation eliminating means comprising:

(a) feedback means associated with each antenna in the array for adjusting the amplitude and phase of signals therein so that unwanted signals from the array are cancelled;

(b) reference signal producing means including a closed circuit coupled to said feedback means with means for selectively picking off at least a portion of a desired signal and circuitry utilizing the picked off portion to generate a reference signal, which reference signal is applied to said feedback means to prevent said feedback means from forming a null on the desired signal; and (c) phase shifting means coupled into the closed circuit of said reference signal producing means for adjusting the phase of the reference signal to compensate for phase shifts between the desired signal and the reference signal.

2. Weight oscillation eliminating means as claimed in claim 1 wherein the closed circuit of the reference signal producing means includes subtracting circuitry, which subtracting circuitry is also connected in the feedback means, for receiving the desired signal from the feedback means and the reference signal from the closed circuit and preventing the desired signal from being fed back to form a null thereon.

3. Weight oscillation eliminating means as claimed in claim 2 wherein the subtracting circuitry includes a 90° hybrid circuit.

4. Weight oscillation eliminating means as claimed in claim 1 wherein the reference signal producing means includes correlating means for comparing the phases of the desired signal and the reference signal and for supplying an error signal to the phase shifting means.

5. In a multiple antenna array including null steering apparatus of the type utilizing reference signal generating means for preventing a null on a desired signal; weight oscillation eliminating means comprising:

(a) feedback means associated with each antenna in the array for adjusting the amplitude and phase of signals therein so that unwanted signals from the array are cancelled;

(b) reference signal producing means coupled to said feedback means with means for selectively picking off at least a portion of a desired signal and circuitry utilizing the picked off portion to generate a reference signal;

(c) phase shifting means coupled to said reference signal producing means for receiving the reference signal and shifting the phase thereof in accordance with signals applied to a control input thereof;

(d) subtracting circuitry coupled to said phase shifting means and said feedback means for utilizing the reference signal to subtract portions of the desired signal which correlate with the reference from the feedback means; and (e) correlating means coupled to said feedback means and said phase shifting means for receiving the desired signal and the reference signal, respectively, and providing an error signal, representative of the noncorrelation therebetween, and for supplying the error signal to the control input of said phase shifting means.

6. Weight oscillation eliminating means as claimed in claim 5 wherein the phase shifting means is adjusted to shift the phase of the reference signal by 90°, the subtracting circuitry subtracts substantially all of the desired signal when the reference signal is 90° out of phase, and the correlating means produces substantially zero error signal with a 90° phase difference between the applied signals.

7. Weight oscillation eliminating means as claimed in claim 6 wherein the correlating means includes a mixer.

8. Weight oscillation eliminating means as claimed in claim 6 wherein the subtracting circuitry includes a 90° hybrid circuit.

* * * * *